US006220432B1

(12) United States Patent
Tan

(10) Patent No.: US 6,220,432 B1
(45) Date of Patent: Apr. 24, 2001

(54) DETACHABLE GOLF BAG LOGO PANEL MOUNTING STRUCTURE

(76) Inventor: Fu-Hsing Tan, 4th Fl., 101-1, Chi Lin Road, Yang chou Tsun, Lu Chu, Taoyuan Hsien (TW)

( * ) Notice: Subject to any disclaimer, the term of this patent is extended or adjusted under 35 U.S.C. 154(b) by 0 days.

(21) Appl. No.: 09/397,698

(22) Filed: Sep. 16, 1999

(51) Int. Cl.[7] ..... A63B 55/00
(52) U.S. Cl. ..... 206/315.3; 206/315.5
(58) Field of Search ..... 206/315.3, 315.5; 224/235, 665, 236; 220/370, 372, 844, 287; 383/38

(56) References Cited

U.S. PATENT DOCUMENTS 583,629 * 6/1897 Olenbusch ..... 220/844
4,344,660 * 8/1982 Molnar et al. ..... 312/250
4,768,650 * 9/1988 Chancellor, Jr. ..... 206/315.3
4,830,248 * 5/1989 Pommenville ..... 224/269
5,033,161 * 7/1991 Chavez ..... 16/262
5,372,415 * 12/1994 Tisbo et al. ..... 312/108
5,425,452 * 6/1995 Shanks et al. ..... 206/315.2 X
5,560,479 * 10/1996 Leyba et al. ..... 206/315.3 X
5,699,906 * 12/1997 Lombardo et al. ..... 206/315.3
5,785,173 * 7/1998 Kim ..... 206/315.6
5,860,519 * 1/1999 Meyer et al. ..... 206/315.3
5,867,600 * 1/1999 Akutsu ..... 224/235

* cited by examiner

*Primary Examiner*—Allan N. Shoap
*Assistant Examiner*—Tri M. Mai
(74) *Attorney, Agent, or Firm*—Dougherty & Troxell

(57) ABSTRACT

A golf bag logo panel including a fixed member fixedly fastened to the golf bag, the fixed member having a plurality of axially aligned tooth profile barrels and a movable member fixedly fastened to a logo panel, the movable member having a plurality of toothed profile barrels engaging with the barrels of the fixed member. A pivot pin is detachably inserted through the barrels of the movable member and the barrels of the fixed member to secure the movable member and the logo to the fixed member and the golf bag, enabling the logo panel to be turned about the pivot pin relative to the golf bag.

5 Claims, 6 Drawing Sheets

DETACHABLE GOLF BAG LOGO PANEL MOUNTING STRUCTURE

BACKGROUND OF THE INVENTION

The present invention relates to a detachable golf bag logo panel mounting structure, and more particularly to such an detachable golf bag logo panel mounting structure, which uses a hinge to secure a logo panel to a golf bag, enabling the logo panel to be turned about an axis relative to the golf bag and automatically set at the adjusted angle. The logo panel can be detached from the golf bag simply by removing the pivot pin from the hinge.

A golf bag is generally equipped with a logo panel. The logo panel is detachably fastened to the golf bag by a zip fastener. This logo panel mounting design has drawbacks. Because the zip fastener is not very strong, the logo panel tends to be opened when stretched or pulled. Further, the peripheral edge of the logo panel tends to be jammed in the interlocking teeth of the zip fastener, causing the zip fastener to be damaged.

SUMMARY OF THE INVENTION

The present invention eliminates the aforesaid drawbacks. According to the present invention, a fixed member which has a plurality of axially aligned tooth profile barrels is fixedly fastened to a golf bag, a movable member which has a plurality of axially aligned tooth profile barrels is fixedly fastened to a logo panel, and a pivot pin is detachably inserted into the barrels at the movable member and the barrel at the fixed member to hold the barrels in an engaged condition, enabling the movable member to be turned with the logo panel relative to the fixed member and the golf bag to the desired angle.

DETAILED DESCRIPTION OF THE PREFERRED EMBODIMENT

Figure 1:
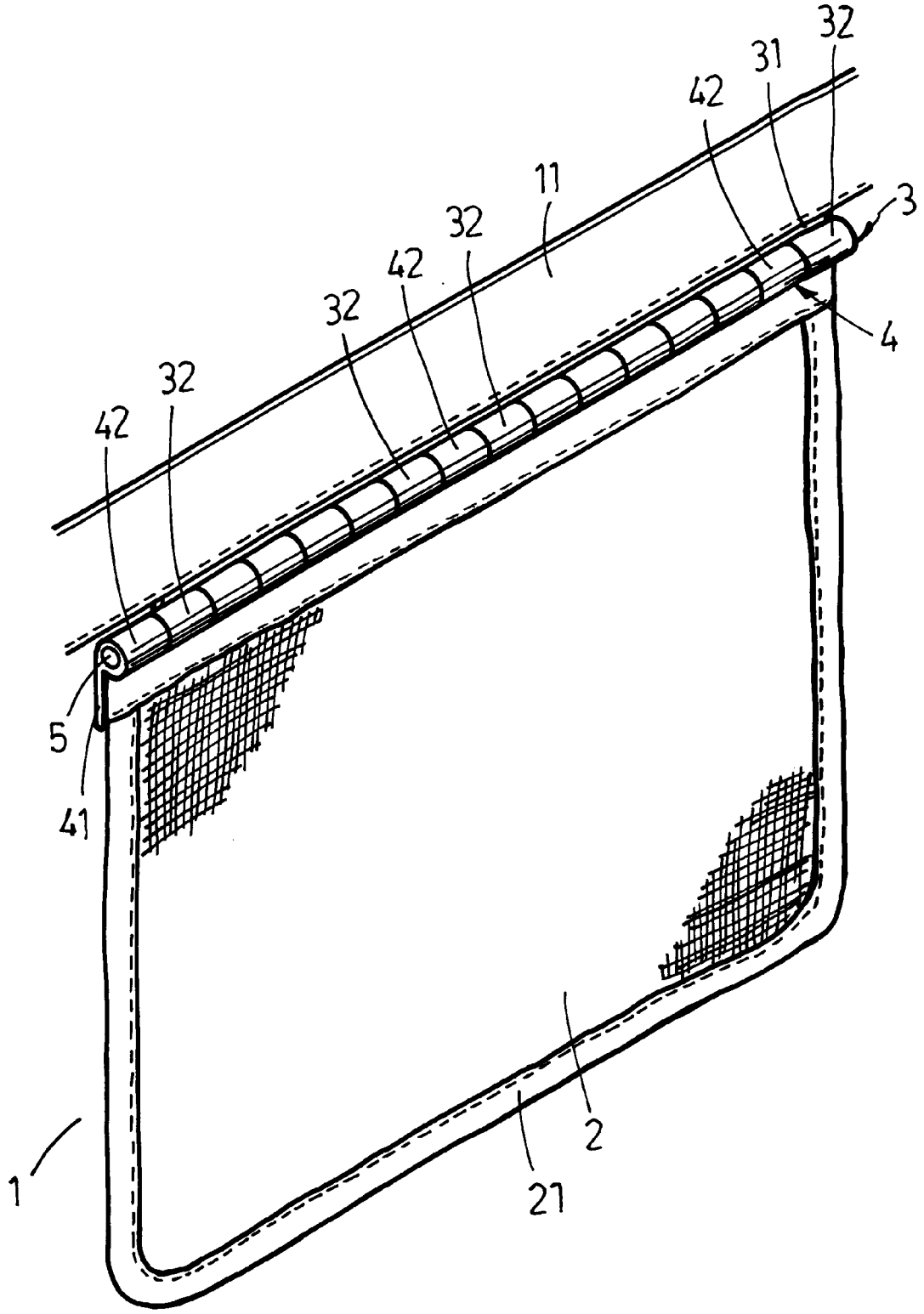
FIG. 1 illustrates a logo panel mounted on a golf bag according to the present invention.
Figure 2:
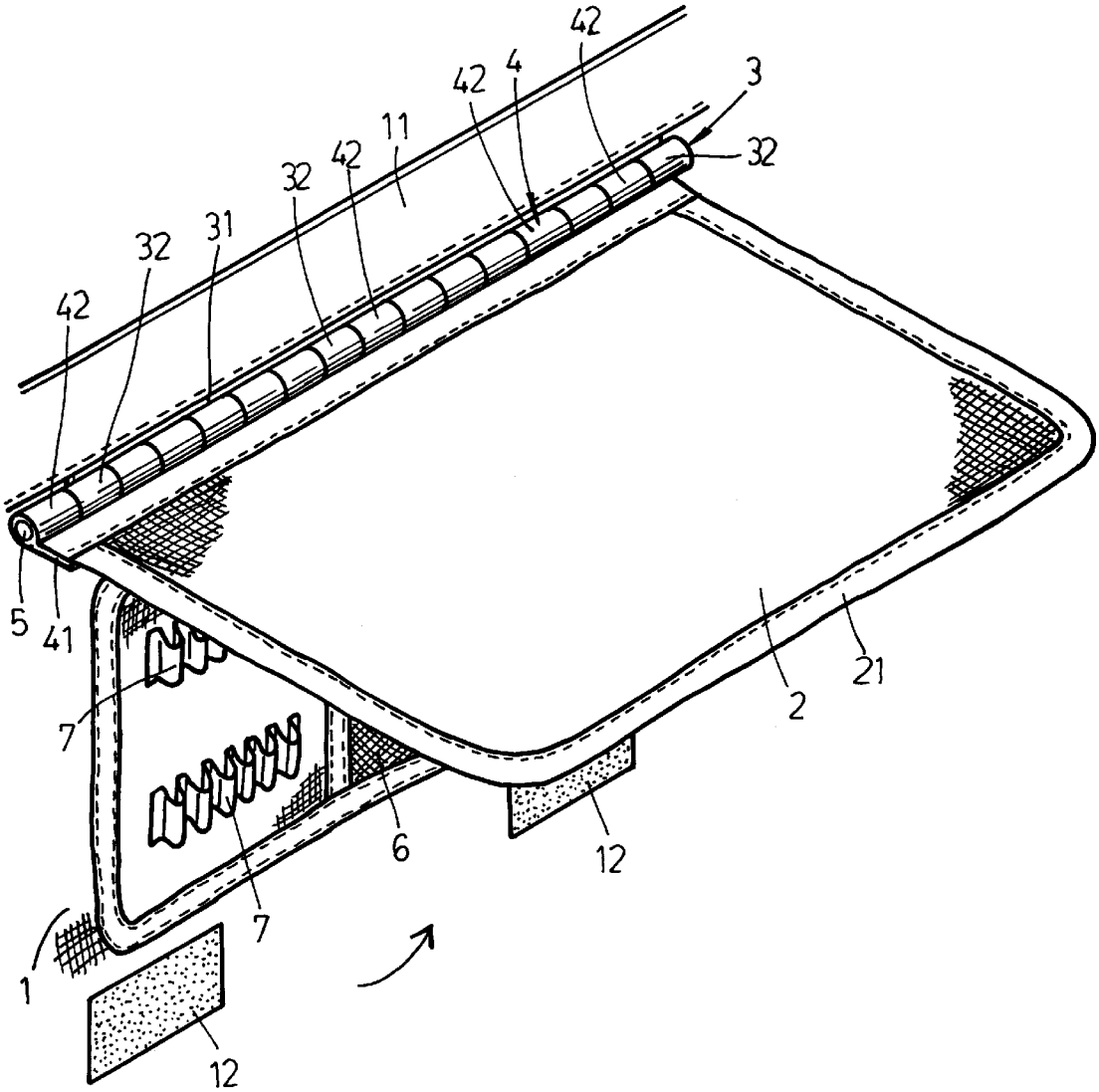
FIG. 2 is similar to FIG. 1 but showing the log panel opened from the golf bag.
Figure 3:
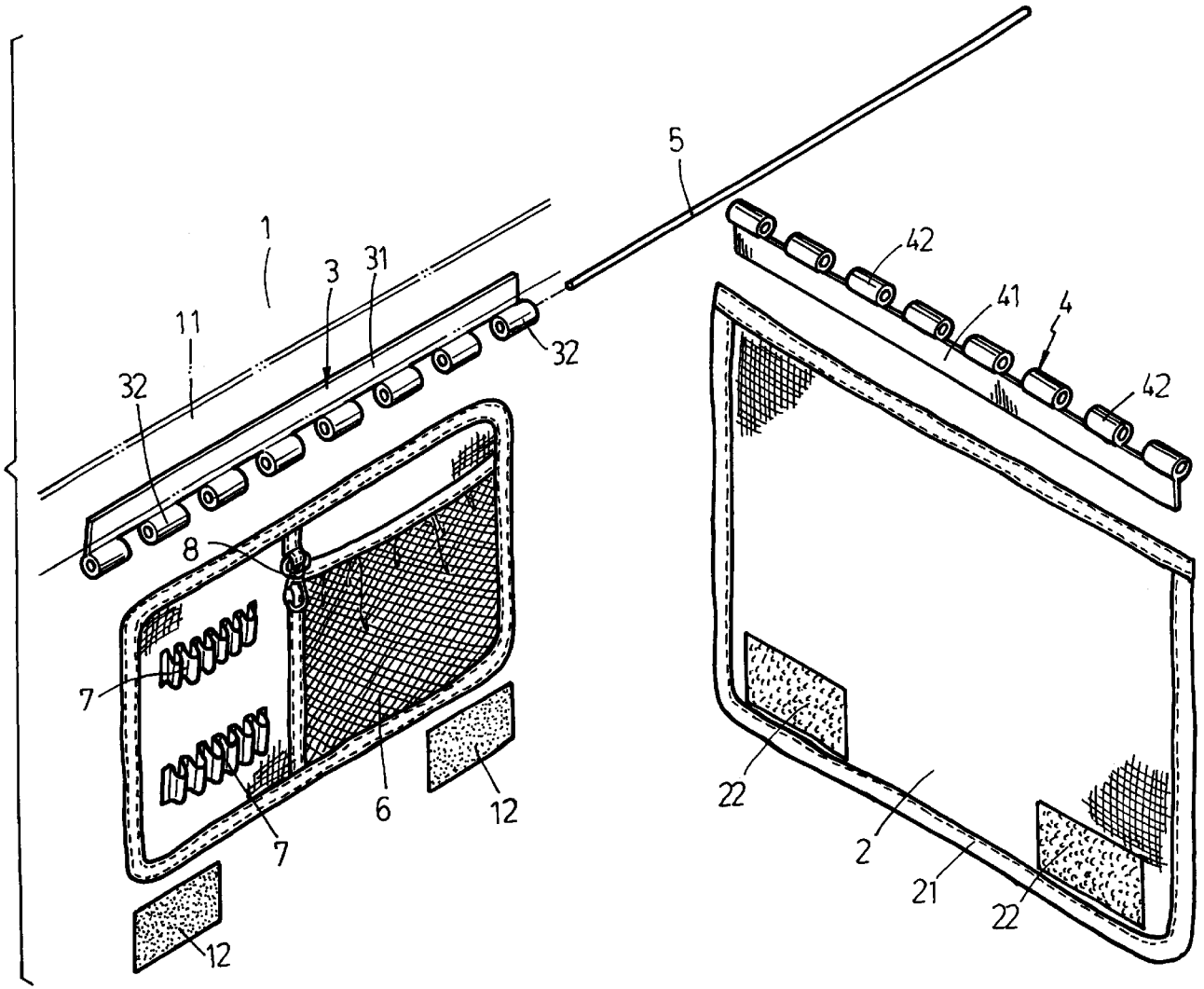
FIG. 3 is an exploded view of FIG. 2.

Referring to FIGS. from 1 through 3, a logo panel 2 is shown coupled to a golf bag 1. The logo panel 2 comprises a peripheral frame 21, and strips of hook (or loop) material 22 at the backside wall thereof. The golf bag 1 comprises strips of loop (or hook) material 12 at the outside wall thereof at locations corresponding to the strips of hook (or loop) material 22 at the logo panel 2. By means of the strips of hook (or loop) material 22 at the logo panel 2 and the strips of loop (or hook) material 12 at the golf bag 1, the logo panel 2 can be detachably fastened to the golf bag 1. The golf bag 1 comprises an organizer pocket 6, tee holders 7 and a keys holder 8 at the outside wall corresponding to the logo panel 2.

Coupling means is provided for securing the logo panel 2 to the golf bag 1, enabling the logo panel 2 to be turned about an axis. The coupling means comprises a fixed member 3, a movable member 4, and a pivot pin 5. The fixed member 3 comprises a narrow elongated mounting strip 31 fixedly fastened to the golf bag 1, and a plurality of tooth profile barrels 32 formed integral with the mounting strip 31 and axially aligned in a line. An elongated ornamental tape 11 is covered on the mounting strip 31, and fixedly fastened with the mounting strip 31 to the golf bag 1 by stitches. The movable member 4 comprises a narrow elongated mounting strip 41 fixedly fastened to the top side of the logo panel 2 by, for example, stitches, and a plurality of tooth profile barrels 42 formed integral with the mounting strip 41 and axially aligned in a line. The pitch between the barrels 42 of the movable member 4 is approximately equal to the axial length of the barrels 32 of the fixed member 3, so that the barrels 32 of the fixed member 3 can be engaged with the barrels 42 of the movable member 4. When the barrels 32 and 42 are engaged, the pivot pin 5 is inserted axially through the barrels 32 and 42 to secure the fixed member 3 and the movable member 4 together, enabling the movable member 4 to be turned about the pivot pin 5 relative to the fixed member 3. The logo panel 2 is made of canvas, and peripherally reinforced with the peripheral frame 21. The peripheral frame 21 keeps the logo panel 2 in shape. When the strips of hook (or loop) material 22 at the logo panel 2 are disengaged from the strips of loop (or hook) material 12 at the golf bag 1, the logo panel 2 can then be turned about the pivot pin 4 and lifted from the golf bag 1. Because the barrels 32 and 42 are engaged with one another, the logo panel 2 is immediately retained in position when released after having been turned about the pivot pin 5 to the desired angle. After opening of the logo panel 2 from the golf bag 1, the user can pick up things from, or put things in the organizer pocket 6, the tee holders 7 and the key holder 8.

After removal of the pivot pin 5 from the fixed member 3 and the movable member 4, the logo panel 2 can then be separated from the golf bag 1, enabling the logo panel 2 to be printed with the desired printing, or replaced with a new one.

Further, because the fixed member 3 and the movable member 4 have tooth profile barrels 32 and 42 meshed together and pivotally secured together by the pivot pin 5, a high tensile strength is provided between the golf bag 1 and the logo panel 2.

Figure 4:
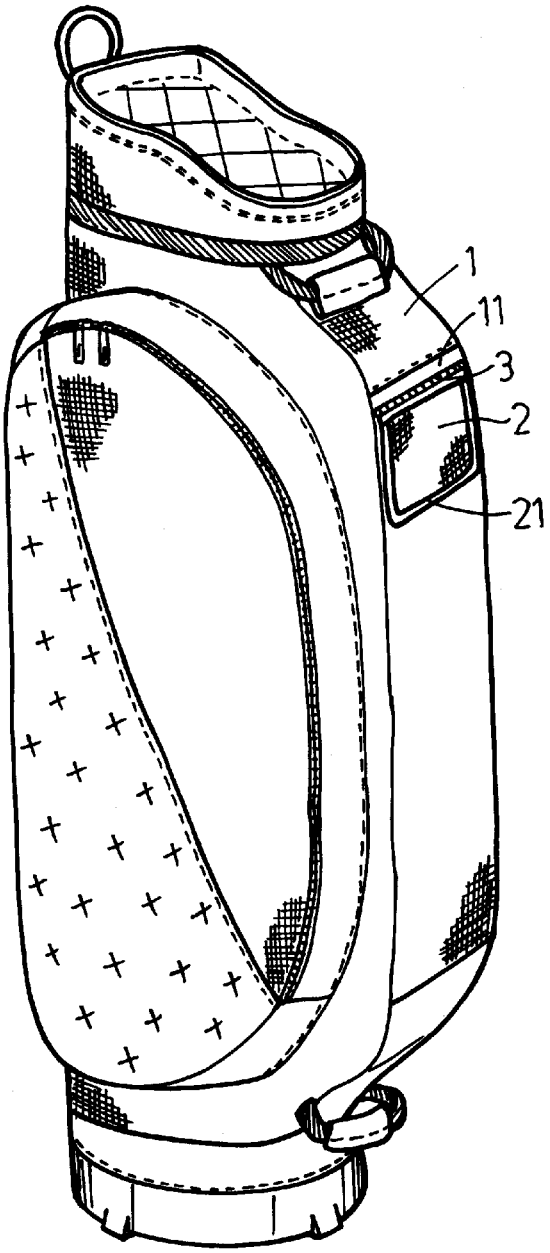
FIG. 4 illustrates a logo panel is mounted on the front garment packet of the golf bag according to the present invention.
Figure 5:
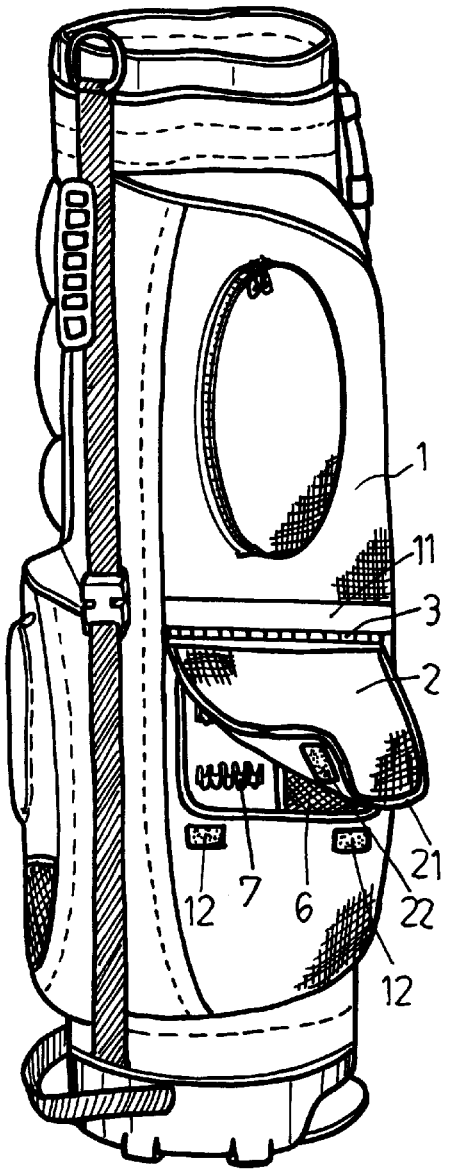
FIG. 5 illustrates a logo panel mounted on one side pocket of a golf bag according to the present invention.
Figure 6:
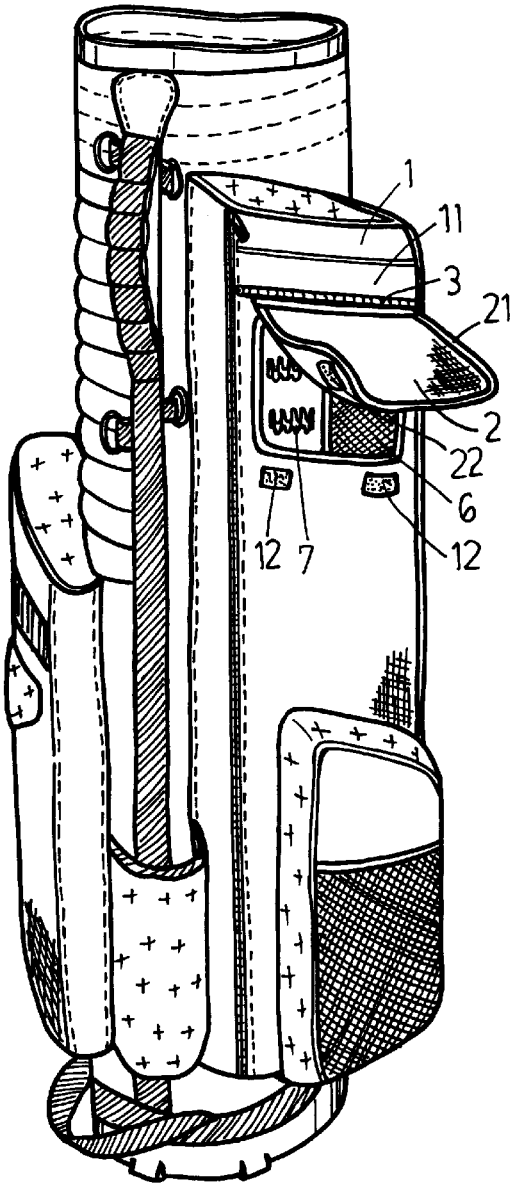
FIG. 6 illustrates a logo panel mounted on one side pocket of another golf bag according to the present invention.
Figure 7:
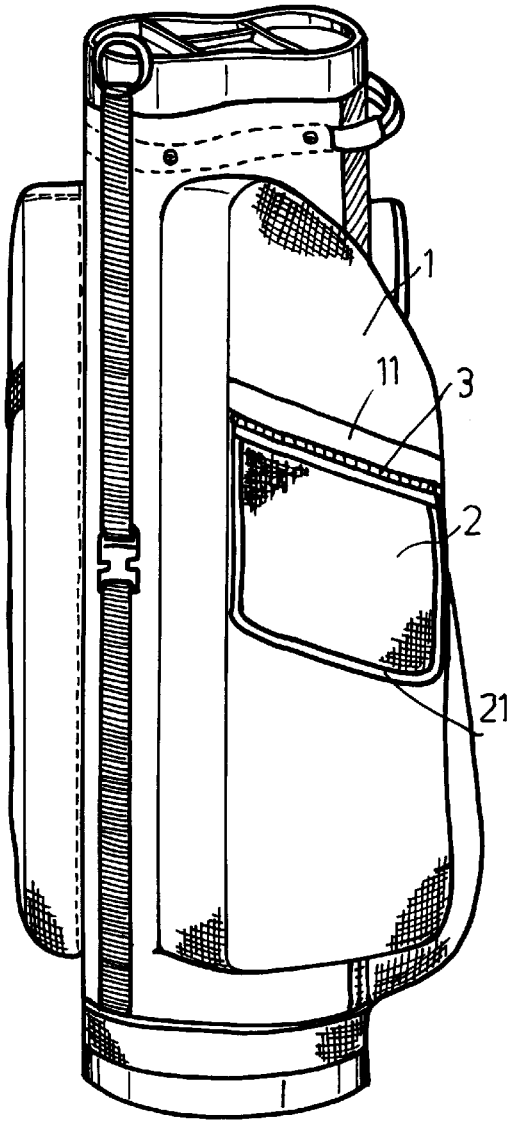
FIG. 7 illustrates a logo panel mounted on one side pocket of still another golf bag according to the present invention.

FIG. 4 shows an application example of the present invention, in which the logo panel 2 is mounted on the front garment pocket of the golf bag 1. FIGS. 5 through 7 show other different application examples of the present invention, in which every golf bag 1 has a respective side pocket at a different location, and a respective logo panel 2 detachably covered on the respective side pocket.

Figure 8:
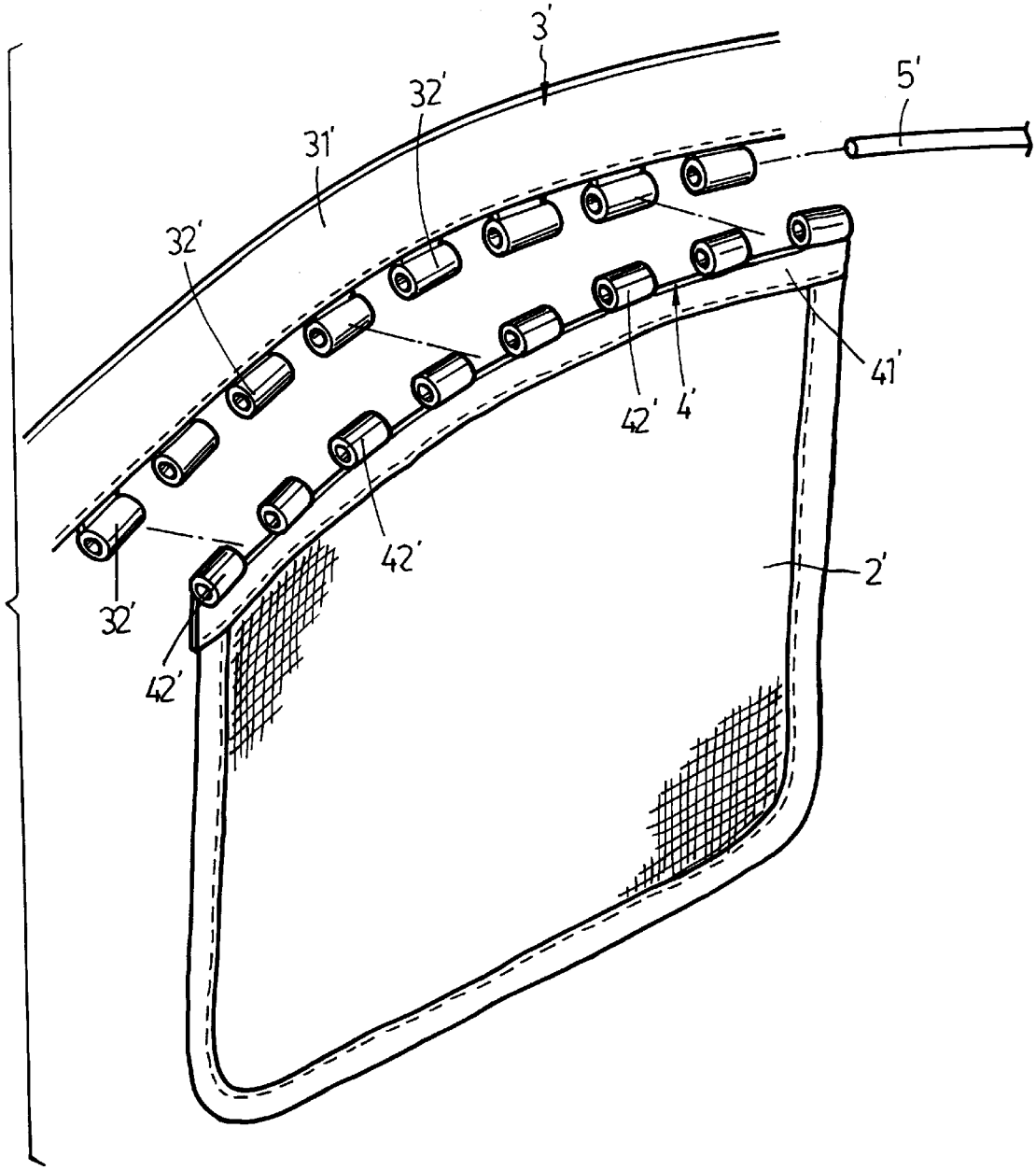
FIG. 8 illustrates an alternate form of the present invention.

Referring to FIG. 8, the mounting strips 31' of the fixed member 3' and the mounting strip 41' of the movable member 4' are respectively smoothly arched. When the barrels 32' and 42' are respectively meshed with one another, the meshed barrels 32' and 42' define a smoothly arched axle hole into which a smoothly arched pivot pin 5' is inserted. This alternate form causes a sense of beauty. Because the curvature of the fixed member 3' and the movable member 4' is limited to a small angle, and the gap in between the barrels 32' and 42' is relatively increased, the logo panel 2 can be smoothly turned about the pivot pin 5'. When the pivot pin 5' is taken away from the barrels 32' and 42', the logo panel 2' is detached from the fixed member 3'.

It is to be understood that the drawings are designed for purposes of illustration only, and are not intended as a definition of the limits and scope of the invention disclosed.

What the invention claimed is:

1. A golf bag having an exterior pocket and comprising:

a) a fixed member including a first elongated mounting strip mounted on the exterior pocket and a plurality of spaced apart, tooth profile first barrels on the fist mounting strip;

b) a logo panel having a reinforcing, peripheral frame;

c) a movable member including a second elongated mounting strip mounted on the logo panel and a plurality of spaced apart, tooth profile second barrels on the second mounting strip; and, d) a pivot pin removably inserted through the pluralities of first and second barrels so as to removably and pivotally attach the logo panel to the golf bag, whereby engagement between the first and second barrels enables the logo panel to pivot with respect to the golf bag about the pivot pin and automatically retains the logo panel in a desired angle relative to the golf bag.

2. The golf bag of claim 1 wherein the logo panel is made of canvas material.

3. The golf bag of claim 2 wherein the pluralities of first and second barrels, and the pivot pin are all arcuately curved.

4. The golf bag of claim 1 further comprising at least one fastener interposed between the exterior pocket and the logo panel to releasably hold the logo panel in a closed position.

5. The golf bag of claim 4 wherein the at least one fastener comprises at least one hook and loop fastener.

* * * * *